US006739325B1

(12) United States Patent
Paulson

(10) Patent No.: US 6,739,325 B1
(45) Date of Patent: May 25, 2004

(54) BALL THROWING MACHINE

(75) Inventor: Kerry K. Paulson, Sherwood, OR (US)

(73) Assignee: Jugs, Inc., Tualatin, OR (US)

( * ) Notice: Subject to any disclaimer, the term of this patent is extended or adjusted under 35 U.S.C. 154(b) by 294 days.

(21) Appl. No.: 09/479,576

(22) Filed: Jan. 7, 2000

Related U.S. Application Data

(60) Provisional application No. 60/115,776, filed on Jan. 13, 1999.

(51) Int. Cl.[7] ..... F41B 4/00
(52) U.S. Cl. ..... 124/78
(58) Field of Search ..... 124/78

(56) References Cited

U.S. PATENT DOCUMENTS 3,724,437 A * 4/1973 Halstead ..... 124/78
3,811,421 A * 5/1974 Betten ..... 124/78
4,026,261 A * 5/1977 Paulson et al. ..... 124/78
4,372,284 A * 2/1983 Shannon et al. ..... 124/78
4,423,717 A * 1/1984 Kahelin ..... 124/78
4,531,504 A * 7/1985 Gilreath ..... 124/78
4,834,060 A * 5/1989 Greene ..... 124/78
6,190,271 B1 * 2/2001 Rappaport et al. ..... 124/78 X

* cited by examiner

*Primary Examiner*—John A. Ricci
(74) *Attorney, Agent, or Firm*—Olson & Olson

(57) ABSTRACT

A ball throwing machine includes a frame mounting a pair of rotary wheels provided with substantially identical pneumatic tires preferably made of non-marking rubber or synthetic elastomer and each having a diameter ranging between about 6–14 inches (15–35 cm); a wall depth ranging between about 1–4 inches (2.5–10 cm); and a footprint ranging between about 0.25–6 inches (0.6–15 cm). The frame mounts a pair of electric motors each associated with one of the rotary wheels for rotating the latter, and the frame may support a battery source of electric potential for the electric motors.

5 Claims, 2 Drawing Sheets

BALL THROWING MACHINE

This application claims the benefit of Provisional application, Serial No. 60/115,776 filed Jan. 13, 1999.

BACKGROUND OF THE INVENTION

This invention relates to ball throwing machines, and more particularly to a ball throwing machine that is of minimum size and weight.

Ball throwing machines provided heretofore are characterized by large size, presenting difficulties in transport and storage. They also are of considerable weight, presenting difficulties in manipulation and preventing use of portable power. Such ball throwing machines are exemplified in U.S. Pat. Nos.: 3,774,584; 4,193,591; RE30,703; and 4,760,835.

SUMMARY OF THE INVENTION

The ball throwing machine of this invention is of reduced size and weight by minimizing the size and weight of the ball throwing wheel or wheels and the size of the electric drive motors, enabling use of batteries for powering the motors.

It is the principal objective of this invention to provide a ball throwing machine that overcomes the aforementioned limitations and disadvantages of prior ball throwing machines.

Another objective of this invention is the provision of a ball throwing machine of the class described which is capable of being disassembled into lightweight components, facilitating transport and storage.

A further objective of this invention is to provide a ball throwing machine of the class described that is of simplified construction for economical manufacture, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figure 1:
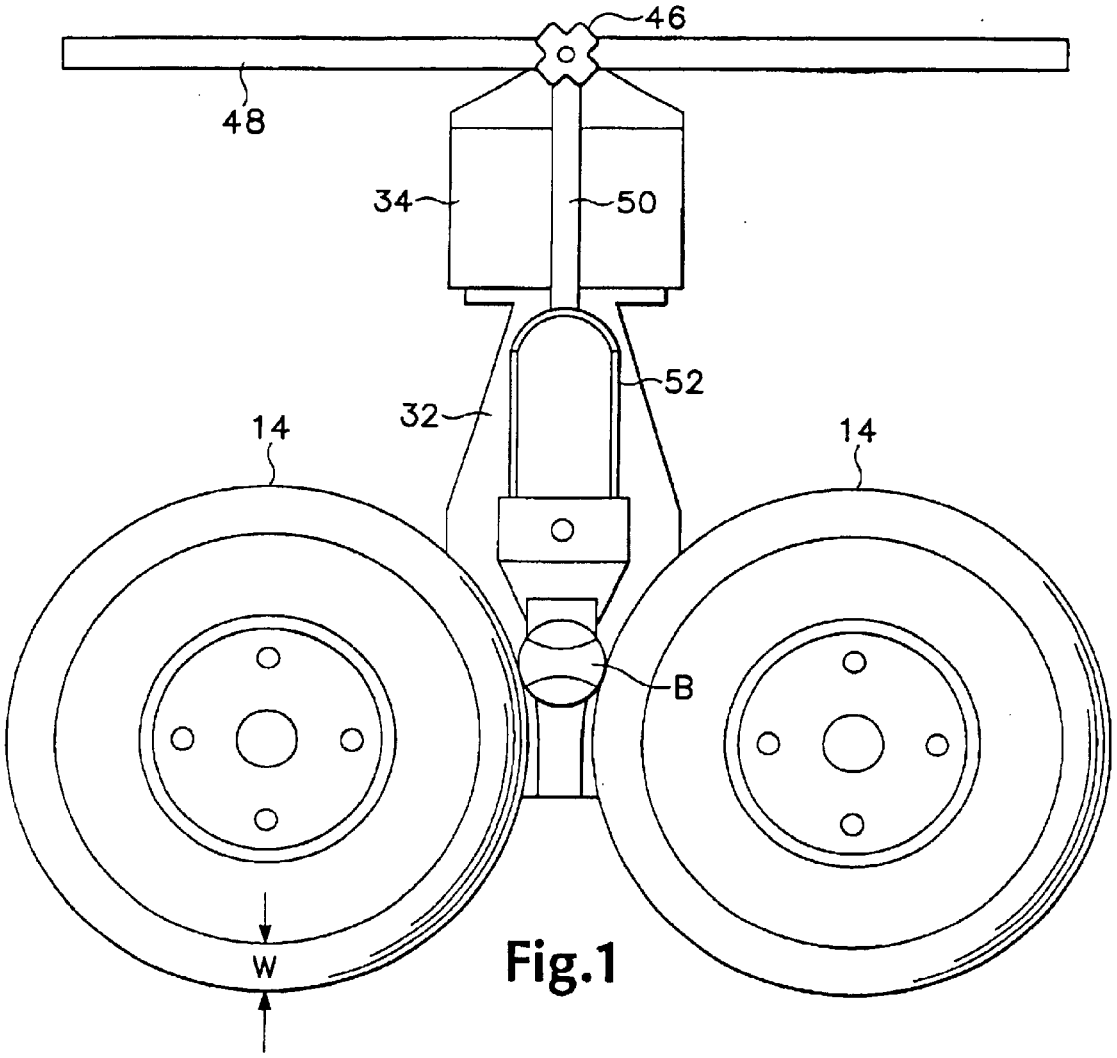
FIG. 1 is a plan view of a ball throwing machine embodying the features of this invention.

The embodiment of ball throwing device illustrated in the drawings includes a laterally elongated base member 10 supporting electric motors 12 which, in turn, support wheels mounting pneumatic tires 14. The electric motors drive the wheels in opposite directions of rotation and in a substantially common plane P.

The spacing between the confronting surfaces of the tires 14 is slightly less than the diameter of a ball B to be thrown. Accordingly, the ball is gripped between the rotating wheels and ejected forwardly therefrom.

The drive motors preferably are of the variable speed type in order to accommodate adjustment of the rotational speed of each wheel independently of the other.

The base member 10 is supported by a universal pivot ball 16 mounted on the top end of a support arm 18. The lower end of the support arm is contained in a socket at the top of a base support 20.

The lower end of the base support is flared outwardly and provided with three leg sockets 22 spaced 120° apart and diverging downwardly. The hollow center of the lower end of the base support receives a clamp member 24 of truncated conical shape, configured for clamping the upper ends of three tripod support legs 26. This clamping is effected by a clamp screw 28 having a reduced diameter inner section threaded for the reception in a threaded bore in the base support 20. A shoulder at the juncture of the clamp screw 28 and inner section abuts the lower end of the clamp member 24 to move the latter upwardly toward the base support 20, whereby to clamp the legs securely but removably to the base support. The clamp screw 28 is turned by means of a T-handle 30.

A pivot clamp 32 is provided adjacent its forward end with a socket for the pivot ball 16. The front end of the pivot clamp member is connected adjustably to the forward, central portion of the base member 10. The rearward end of the pivot clamp member mounts the forward side of control box 34 which contains the electrical control unit for varying the speeds of rotation of the tires 14. The control box also may be configured to contain a portable electric battery supply for the motors. The electrical control unit includes potentiometers having control knobs 36 disposed at the top of the control box.

The rear side of the control box supports the vertical section 38 of a clamp bar. The horizontal section 40 of the clamp bar is provided with a threaded opening for receiving the reduced diameter threaded shank 42 of a clamp screw 44. The upper end of the clamp screw is provided with a hand knob 46 to facilitate its manipulation.

The threaded shank 42 extends freely through an opening at the juncture of the cross bar 48 of a T-handle the leg 50 of which extends forwardly for attachment to the base member 10. By rotating the clamp screw 44 to move it into or out of the horizontal section 40, the rearward end of clamp member 24 and leg 50 are moved toward or away from each other to clamp or release the base member 10 and clamp member 24 to or from the pivot ball 16. This allows readjustment of the rotational plane P of the ball projecting tires 14 by hand manipulation of the T-handle cross bar 48.

The base 10 mounts a ball feeder 52 the structure of which is described in detail in U.S. Pat. No. 4,760,835 aforesaid.

Figure 4:
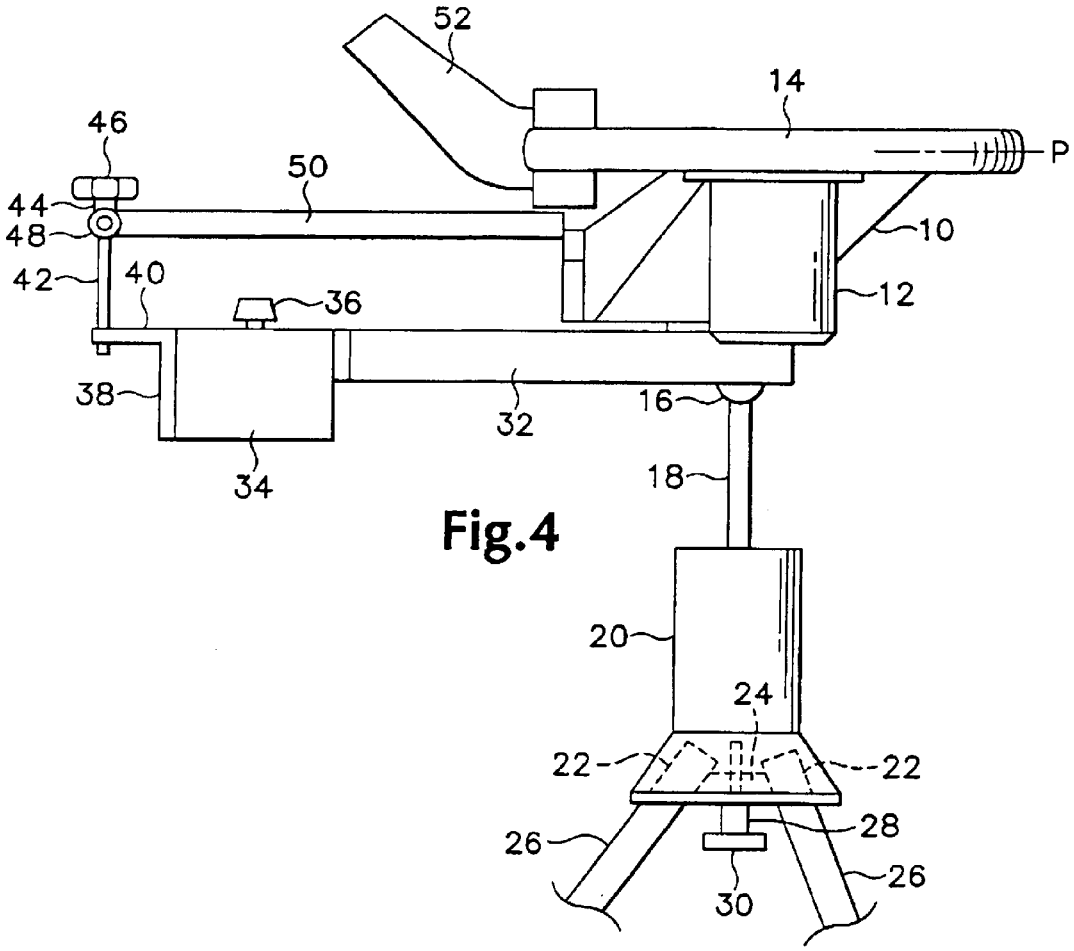
FIG. 4 is a fragmentary side elevation of the ball throwing machine of FIG. 1 with the pneumatic tire of FIG. 2.
Figure 5:
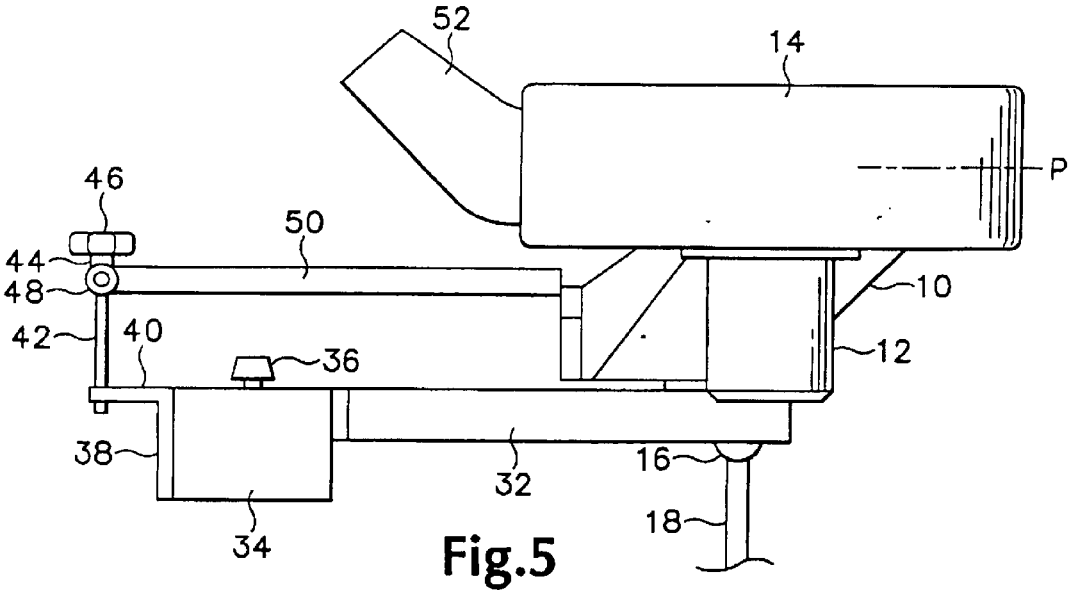
FIG. 5 is a fragmentary side elevation similar to FIG. 4 with the pneumatic tire of FIG. 3.

FIGS. 4 and 5 of the drawings show the device adjusted to the position in which the rotational plane P of the wheels is horizontal, for delivery of the ball B on an initial horizontal line. Adjustment of the trajectory of a ball in order to have the ball arrive at the batter's plate at various elevations relative to the strike zone, is accomplished by rotating knob 46 to loosen the clamping pressure on the pivot ball 16, and then moving the cross bar 48 manually to change the trajectory as desired.

The foregoing is a general description of a ball throwing machine of the type disclosed in the patents identified hereinbefore. This invention is directed to the provision of smaller and lighter wheels and tires 14 and correspondingly smaller and lighter drive motors 12, enabling the use of a battery source of potential for driving the motors. By reducing the size and weight of these components, the ball throwing machine is capable of being disassembled into a plurality of lightweight parts that are easily carried and stored in the trunk of an automobile or other small space. The use of batteries renders the machine more versatile in use since it is not dependent upon a fixed source of electrical power.

Figure 2:
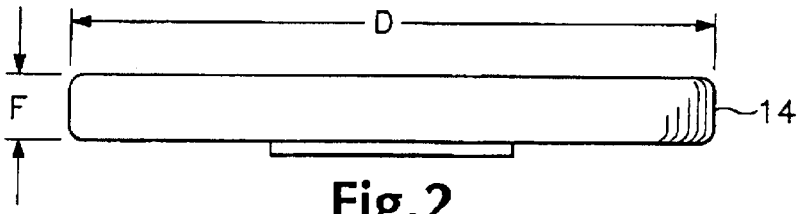
FIG. 2 is a side elevation of a pneumatic tire for use in the machine of FIG. 1.
Figure 3:
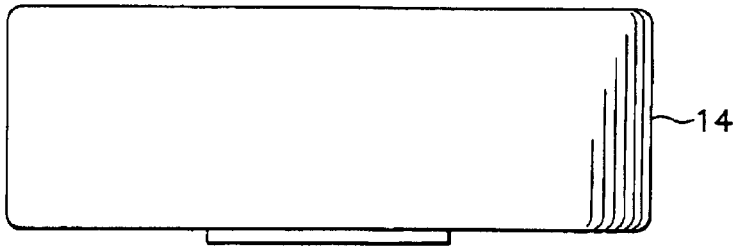
FIG. 3 is a side elevation similar to FIG. 2 showing a pneumatic tire of substantially greater width for use in the machine of FIG. 1.

The foregoing advantages are achieved by providing pneumatic tires 14 that may range in diameter D (FIG. 2) from 6 inches (15 cm) to 14 inches (35 cm); wall depth W from 1 inch (2.5 cm) to 4 inches (10 cm); and footprint F from 0.25 inch (0.6 cm) to 6 inches (15 cm). FIGS. 2 and 4 illustrate a pneumatic tire having a diameter of about 10 inches (25 cm); a wall depth of about 2 inches (5 cm) and a footprint of about 1 inch (2.5 cm). FIGS. 3 and 5 illustrate a pneumatic tire having a diameter of about 10 inches (25 cm); a wall depth of about 4 inches (10 cm); and a footprint of about 4.5 inches (11.5 cm). The tires preferably are made of non-marking rubber or synthetic elastomer.

It will be apparent to those skilled in the art that various changes may be made in the size, shape, type, number and arrangement of parts described hereinbefore. For example, the ball throwing machine may have only one rotary tire associated with a fixed pad, as in U.S. Pat. No. RE. 30,703, aforesaid. Other changes may be made, as desired, without departing from the spirit of this invention and the scope of the appended claims.

I claim:

1. A baseball throwing machine including a frame supporting at least one ball projecting wheel driven rotationally by an electric motor and mounting a pneumatic tire having a diameter ranging between about 15–32 cm; a wall depth ranging between about 5–10 cm; and a footprint ranging between about 4–13 cm.

2. The baseball throwing machine of claim 1 wherein the pneumatic tire has a diameter of about 15 cm, a wall depth of about 5 cm, and a footprint of about 4 cm.

3. The baseball throwing machine of claim 1 wherein the pneumatic tire has a diameter of about 30 cm, a wall depth of about 10 cm, and a footprint of about 13 cm.

4. The baseball throwing machine of claim 1 including a battery source of electric potential mounted on the frame for driving the electric motor.

5. The baseball throwing machine of claim 1 including two ball projecting wheels each driven rotationally by an associated electric motor and both mounting substantially identical pneumatic tires.

* * * * *